US008087560B2

(12) United States Patent
Crye

(10) Patent No.: US 8,087,560 B2
(45) Date of Patent: Jan. 3, 2012

(54) ACCESSORY ATTACHMENT SYSTEM

(75) Inventor: Caleb Clark Crye, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 783 days.

(21) Appl. No.: 12/184,689

(22) Filed: Aug. 1, 2008

(65) Prior Publication Data

US 2009/0084822 A1 Apr. 2, 2009

Related U.S. Application Data

(60) Provisional application No. 60/953,883, filed on Aug. 3, 2007.

(51) Int. Cl.
*A45F 3/00* (2006.01)

(52) U.S. Cl. ..... 224/675; 224/665; 224/674; 224/660

(58) Field of Classification Search ..... 224/660, 224/674–676, 665
See application file for complete search history.

(56) References Cited

U.S. PATENT DOCUMENTS

| | | | | |
|---|---|---|---|---|
| 2,557,445 | A | 6/1951 | Lewallen | |
| 3,379,349 | A | 4/1968 | Hier | |
| 3,565,303 | A * | 2/1971 | Kippen | 224/675 |
| 4,299,343 | A | 11/1981 | Atchisson | |
| 4,923,105 | A | 5/1990 | Snyder | |
| 4,982,885 | A * | 1/1991 | Severson et al. | 224/675 |
| 5,054,671 | A | 10/1991 | Else | |
| 5,201,448 | A | 4/1993 | Schue | |
| 5,724,707 | A | 3/1998 | Kirk et al. | |
| 6,119,907 | A | 9/2000 | Benjamin | |
| 6,273,872 | B1 | 8/2001 | Friedman | |
| 6,568,575 | B1 | 5/2003 | Bartholomew | |
| 6,923,357 | B2 | 8/2005 | Smith | |
| 7,082,709 | B2 | 8/2006 | Lindsey | |
| 7,090,102 | B1 * | 8/2006 | Lipke | 224/250 |
| 2006/0237509 | A1 | 10/2006 | Moore, Sr. | |
| 2007/0051645 | A1 * | 3/2007 | Hassett | 206/316.2 |

FOREIGN PATENT DOCUMENTS

| | | | | |
|---|---|---|---|---|
| DE | 3825195 | * | 7/1988 | 224/675 |

OTHER PUBLICATIONS

"Blackwater Gear" catalog, p. 5 © Michaels of Oregon.

(Continued)

*Primary Examiner* — Justin Larson
*Assistant Examiner* — Adam Waggenspack
(74) *Attorney, Agent, or Firm* — Stiennon & Stiennon

(57) ABSTRACT

An accessory system has one or more accessory elements which are removably attachable to a waist belt. A loop is fastened to the rear wall of each accessory element to define a passage between the rear wall and the loop which extends generally perpendicularly to the direction of the belt. A first part of a two-part fastener such as a snap is attached to an exterior surface of the loop. A strap is fastened to the accessory element rear wall spaced from the loop. A second part of the two-part fastener is configured to mate with the first part of the two-part fastener. The second part is fixed to the strap, so the strap is capable of passing through the loop, and around the loop to bring the first part and the second part of the fastener into engagement to retain the belt between the strap and the accessory rear wall.

2 Claims, 1 Drawing Sheet

OTHER PUBLICATIONS

"Tek-Lok Utility Belt Clip", from http://www.blade-tech.com_Tek-Lok-Utility-Belt-Clip-Large-pr-841.html downloaded Jul. 31, 2008.
"Alice Clips", from http://www.uscav.com/Productinfo.aspx?productID=7570&TabID=548 downloaded Aug. 1, 2008.
"Speed-Back", from http://www.slingsonly.com/saw_pouch.html downloaded Aug. 1, 2008.

* cited by examiner

ACCESSORY ATTACHMENT SYSTEM

CROSS REFERENCES TO RELATED APPLICATIONS

This application claims the benefit of U.S. provisional app. 60/953,883, filed Aug. 3, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to arrangements for mounting containers and other elements to garments or carrying systems.

Many active occupations require that practitioners have any number of specialized tools, supplies, and materials on their persons for ready use at any time. Soldiers and police officers, for example, must carry weapons, ammunition, lights, food and beverage, etc. Yet in most situations there is a desire to avoid the carriage of extraneous items which might unnecessarily reduce the speed, agility, and endurance of the carrier. Hence it is desirable that accessories be capable of speedy attachment and removal from the wearer's garment.

Various accessory systems are known for attaching pouches and other elements to belts, vests, or other garments. Yet many of the arrangements which allow a user to clip-on and clip-off a pouch from a belt are heavy, complicated, uncomfortable, or prone to breakage. Another approach is to simply sew a loop on an item and thread the pouch onto a belt. This solves the complexity, bulk, weight, and comfort issues but it also means that, in order to remove one item, a user must often disassemble all the items threaded onto the belt. In the case of police and military applications, there are sometimes so many items on a user's belt that the added complication of having to disassemble a system that has been modified and fitted to the user's needs causes the user to avoid further adjustment of the configuration at the cost of comfort, better access to items, or entire new capabilities.

What is needed is an attachment system which does not require the user to remove more than one accessory at a time to reposition a single accessory.

SUMMARY OF THE INVENTION

The attachment system of the present invention allows a pouch or other accessory element to be securely mounted to a belt, vest, or pack. The attachment system allows the pouch to be easily added to or removed from the item it is mounted to. The accessory system has one or more accessory elements which are removably attachable to a waist belt, or other strap on a vest or pack. A loop is fastened to the rear wall of each accessory element to define a passage between the rear wall and the loop which extends generally perpendicularly to the direction of the belt. A first part of a two-part fastener such as a snap is attached to an exterior surface of the loop. A strap is fastened to the accessory element rear wall spaced from the loop. A second part of the two-part fastener is configured to mate with the first part of the two-part fastener. The second part is fixed to the strap, so the strap is capable of passing through the loop, and around the loop to bring the first part and the second part of the fastener into engagement to retain the belt between the strap and the accessory rear wall.

It is an object of the present invention to provide an accessory element that can attach to a belt without having to be threaded onto the belt.

It is another object of the invention to provide an accessory element which can be removed from a belt without disturbing other elements attached thereto.

It is also an object of the present invention to provide a secure attachment to a belt or strap for an accessory element.

It is a further object of the present invention to provide a lightweight accessory attachment system which is simple to manufacture.

Further objects, features and advantages of the invention will be apparent from the following detailed description when taken in conjunction with the accompanying drawings.

DESCRIPTION OF THE PREFERRED EMBODIMENTS

Figure 1:
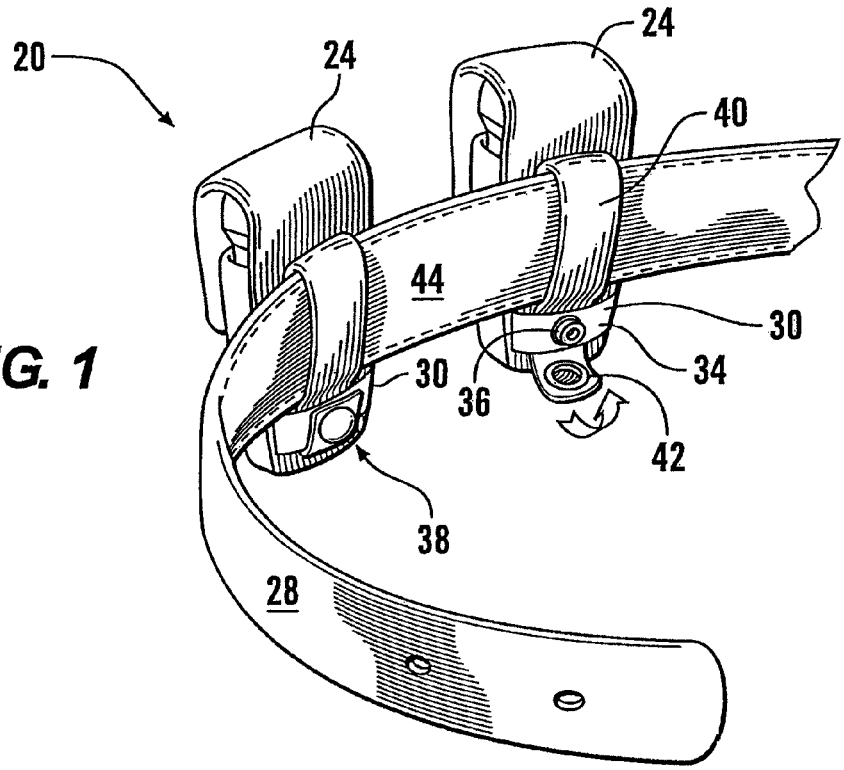
FIG. 1 is a fragmentary perspective view of two pouches in relationship to a belt, the pouches being outfitted with the attachment system of this invention, one being fully attached, and one being partially attached.
Figure 2:
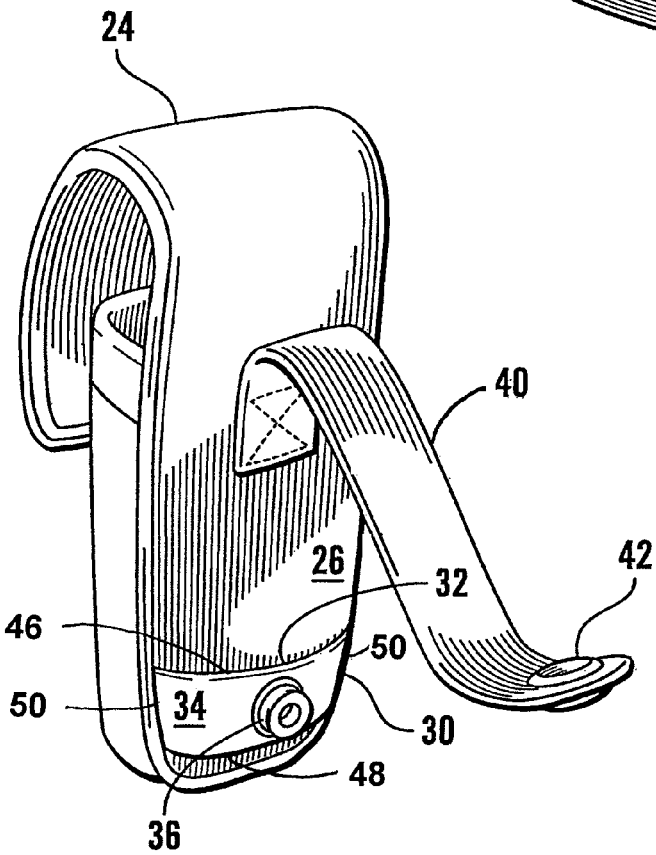
FIG. 2 is a perspective view of a pouch with the attachment system of this invention shown in a condition prior to attachment to a belt.

Referring more particularly to FIGS. 1-2, wherein like numbers refer to similar parts, the accessory attachment system 20 of the present invention has a strap which extends in a first direction, such as a belt 22 which can be worn by a user. One or more accessory elements, such as a pouch 24 are positionable on the belt 22. The pouch 24 may be fabricated of conventional fabric material, and has a rear wall 26 which faces the outwardly facing surface 28 of the belt. A loop 30 is fixed to the rear wall 26, and extends in the same direction as the belt to define a passage 32 which extends upwardly, generally perpendicular to the direction which the belt extends around the user. The loop 30 is formed of flexible fabric, and has a rear surface 34 to which one half 36 of a two-part fastener 38 is mounted. The two-part fastener may be a conventional snap fastener comprised of a projecting stud or male portion which is received within a socket or female portion. A primary tab 40 is an elongated flexible strap of material having one end which is fastened to the rear wall 26 of the pouch 24, such as by sewing to the rear wall. The primary tab 40 is fastened at a first position spaced from the loop 34, for example upwardly from the loop a distance to accommodate the width of the belt to which the accessory is to be attached. The second half 42 of the two-part fastener 38, i.e., the other half of the snap fastener, is affixed to the free end of the primary tab. The loop has a first edge 46 extending in the first direction and spaced from the first position, a second edge 48 extending in the first direction and spaced in the first direction from the first edge. Side edges 50 extend between the first edge and the second edge and are fastened to the rear wall.

To mount the pouch 24 to the belt 22, the rear wall 26 of the pouch is positioned adjacent the outwardly facing surface 28 of the belt, and the primary tab 40 is passed over the inwardly facing surface 44 of the belt and then passed through the passage 32 of the loop at a position beneath the belt. The primary tab 40 is then turned upwardly and the second half 42 of the two-part fastener 38 on the primary tab 40 is connected to the first half of the two-part fastener on the rear of the loop 30, thereby securing the pouch to the belt.

It should be noted that the pouches or other accessory items may be attached in a similar manner to loops or straps which are connected to vests or other garments. That is, the belt may be fully encircling a user, or may extend only a short distance between two fastening points to an underlying garment portion. In addition, the accessory elements may have multiple straps and loops, allowing a wider accessory element to be connected at multiple positions to the belt.

It is understood that the invention is not limited to the particular construction and arrangement of parts herein illustrated and described, but embraces all such modified forms thereof as come within the scope of the following claims.

I claim:

1. An accessory for attachment to an attachment element, the accessory comprising:

an accessory element having a rear wall;

a strap having a first end, the first end fastened at a first position to the rear wall such that the attachment element can extend in a first direction alongside the rear wall between the strap and the rear wall, the strap extending away from the first position and capable of extending over the attachment element, such that the attachment element may be located between the strap and the rear wall as the strap extends from the first position;

a loop fastened to the rear wall to define a passage between the rear wall and the loop, wherein the passage extends in a second direction which is generally perpendicular to the first direction, the loop being spaced in the second direction from the first position of the strap;

a first part of a two part fastener which is attached to an exterior surface of the loop; and a second part of the two part fastener configured to mate with the first part of the two part fastener, the second part of the two-part fastener being fixed to a second end of the strap, wherein the strap extends in the second direction and passes through the loop passage, and around the loop to extend in a third direction that is opposite to the second direction, wherein when the first and second parts of the two part fastener are engaged, the second end of the strap does not extend in the third direction beyond the loop.

2. An accessory for attachment to an attachment element, the accessory comprising:

an accessory element having a rear wall;

a strap having a first end, the first end fastened at a first position to the rear wall such that the attachment element can extend in a first direction alongside the rear wall between the strap and the rear wall, the strap extending away from the first position and capable of extending over the attachment element, such that the attachment element may be located between the strap and the rear wall as the strap extends from the first position;

a loop fastened to the rear wall to define a passage between the rear wall and the loop, wherein the passage extends in a second direction which is generally perpendicular to the first direction, the loop being spaced in the second direction from the first position of the strap;

a first snap fastener which is attached to an exterior surface of the loop; and a second snap fastener configured to mate with the first snap fastener, the second snap fastener being fixed to the second end of the strap, wherein the strap extends in the second direction and passes through the loop passage and around the loop, and wherein the first and second snap fasteners are engaged to retain the attachment element between the strap and the accessory wall.

* * * * *